US010841681B2

(12) United States Patent
Enamito et al.

(10) Patent No.: US 10,841,681 B2
(45) Date of Patent: Nov. 17, 2020

(54) SOUND GENERATING DEVICE

(71) Applicants: Kabushiki Kaisha Toshiba, Tokyo (JP); Toshiba Digital Solutions Corporation, Kanagawa (JP)

(72) Inventors: Akihiko Enamito, Kawasaki Kanagawa (JP); Keiichiro Someda, Kawasaki Kanagawa (JP); Osamu Nishimura, Kawasaki Kanagawa (JP)

(73) Assignees: Kabushiki Kaisha Toshiba, Tokyo (JP); Toshiba Digital Solutions Corporation, Kawasaki (JP)

( * ) Notice: Subject to any disclaimer, the term of this patent is extended or adjusted under 35 U.S.C. 154(b) by 0 days.

(21) Appl. No.: 16/109,095

(22) Filed: Aug. 22, 2018

(65) Prior Publication Data

US 2019/0238965 A1 Aug. 1, 2019

(30) Foreign Application Priority Data

Jan. 29, 2018 (JP) ..... 2018-012999

(51) Int. Cl.
*H04R 1/10* (2006.01)

(52) U.S. Cl.
CPC ..... *H04R 1/1016* (2013.01); *H04R 1/1066* (2013.01); *H04R 1/1075* (2013.01); *H04R 2460/13* (2013.01)

(58) Field of Classification Search
CPC ... H04R 1/10; H04R 9/04; H04R 7/14; H04R 9/025
USPC ..... 381/330, 328, 322, 312
See application file for complete search history.

(56) References Cited

U.S. PATENT DOCUMENTS

| | | | | |
|---|---|---|---|---|
| 5,142,587 | A * | 8/1992 | Kobayashi | H04R 1/1016 181/126 |
| 5,298,692 | A | 3/1994 | Ikeda et al. | |
| 5,459,290 | A | 10/1995 | Yamagishi et a. | |
| 6,307,943 | B1 * | 10/2001 | Yamagishi | H04R 1/1075 181/132 |
| 8,170,262 | B1 * | 5/2012 | Liu | H04R 1/1016 381/382 |
| 2008/0118078 | A1 | 5/2008 | Asada et al. | |
| 2009/0209304 | A1 * | 8/2009 | Ngia | H04R 1/1091 455/575.2 |
| 2010/0166197 | A1 | 7/2010 | Fukuda et al. | |
| 2012/0134524 | A1 * | 5/2012 | Peng | H04R 1/1075 381/380 |
| 2012/0237068 | A1 * | 9/2012 | Fretz | H04R 25/656 381/330 |
| 2015/0003644 | A1 * | 1/2015 | George | H04R 1/42 381/165 |
| 2017/0026751 | A1 | 1/2017 | Suzuki et al. | |
| 2017/0048608 | A1 | 2/2017 | Yang | |

(Continued)

FOREIGN PATENT DOCUMENTS

| | | | |
|---|---|---|---|
| JP | 04-101600 | A | 4/1992 |
| JP | 05-316583 | A | 11/1993 |

(Continued)

*Primary Examiner* — Melur Ramakrishnaiah
(74) *Attorney, Agent, or Firm* — Finnegan, Henderson, Farabow, Garrett & Dunner, L.L.P.

(57) ABSTRACT

A sound generating device according to an embodiment includes a sound tube and a sound generator. The sound tube is to be held between a tragus and an antitragus. The sound generator is disposed inside the sound tube.

4 Claims, 12 Drawing Sheets

(56) References Cited

U.S. PATENT DOCUMENTS

| | | | | |
|---|---|---|---|---|
| 2017/0311070 | A1 | 10/2017 | Igarashi et al. | |
| 2018/0077480 | A1 | 3/2018 | Murozaki | |
| 2018/0098155 | A1* | 4/2018 | Tanaka | H04R 7/06 |
| 2019/0052950 | A1* | 2/2019 | Igarashi | H04R 1/1033 |

FOREIGN PATENT DOCUMENTS

| | | | |
|---|---|---|---|
| JP | 06-113001 | A | 4/1994 |
| JP | 2008-131089 | A | 6/2008 |
| JP | 2010-157852 | A | 7/2010 |
| JP | 2011-23974 | A | 2/2011 |
| JP | 2012-257049 | A | 12/2012 |
| JP | 2013-158039 | A | 8/2013 |
| JP | 2016-63276 | A | 4/2016 |
| JP | 2016-086281 | A | 5/2016 |
| JP | 2017-038354 | A | 2/2017 |
| WO | WO 01/03470 | A1 | 1/2001 |
| WO | WO 2015/141402 | A1 | 9/2015 |
| WO | WO 2016/067700 | A1 | 5/2016 |
| WO | WO 2016/151952 | A1 | 9/2016 |
| WO | WO 2017/061218 | A1 | 4/2017 |

* cited by examiner

SOUND GENERATING DEVICE

CROSS-REFERENCE TO RELATED APPLICATION

Priority is claimed on Japanese Patent Application No. 2018-12999, filed Jan. 29, 2018, the content of which is incorporated herein by reference.

FIELD

Embodiments of the present invention relate to a sound generating device.

BACKGROUND

In recent years, earphones have been worn to block the external auditory foramen. Thereby, it is possible to suppress sound leakage to the surroundings from the earphones. Incidentally, in the service industry and the like, it may also be necessary to hear surrounding sounds while hearing a voice instruction given from a distant place through the earphones. However, in the earphones of the related art, there is a possibility that surrounding sounds may be blocked by the earphones.

DETAILED DESCRIPTION

Figure 1:
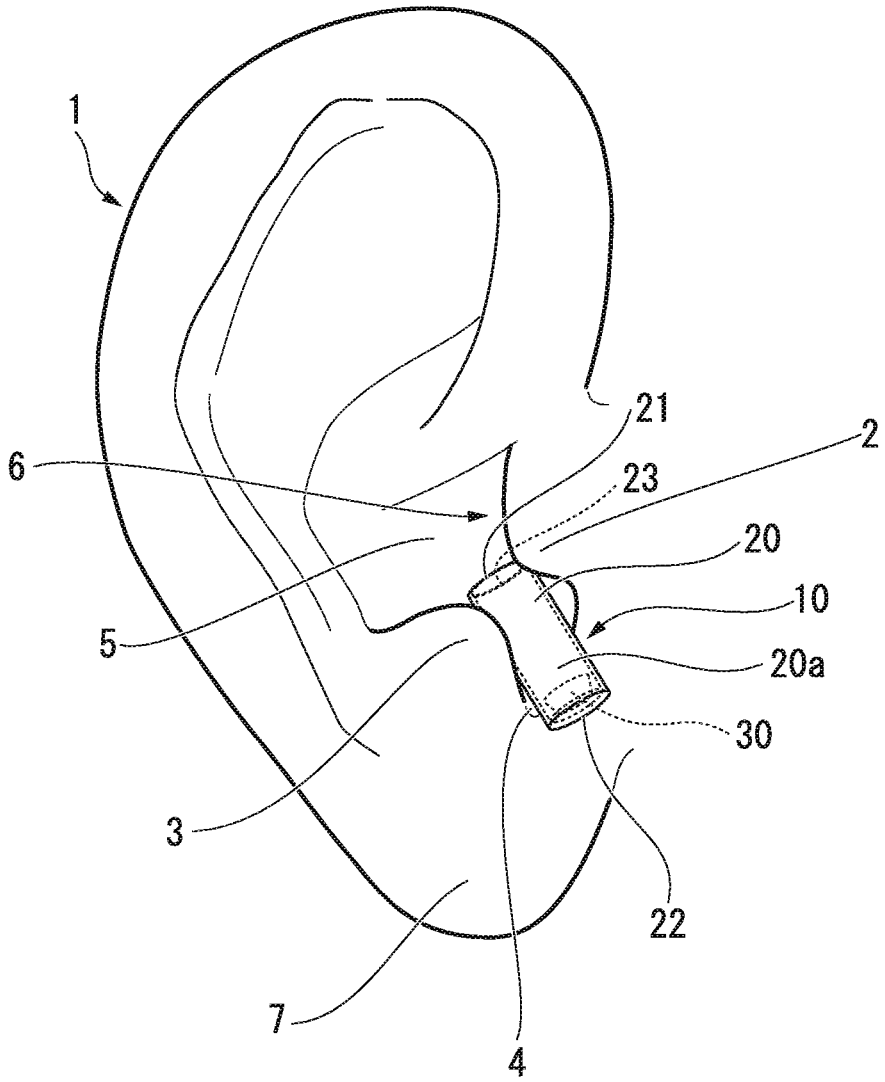
FIG. 1 is a perspective view showing a state in which a sound generating device according to a first embodiment is worn in an auricle.

A sound generating device according to an embodiment includes a sound tube and a sound generator. The sound tube is to be held between a tragus and an antitragus. The sound generator is disposed inside the sound tube.

Hereinafter, the sound generating device according to the embodiment will be described with reference to the accompanying drawings. Meanwhile, in the following description, components having the same or similar functions will be denoted by the same reference numerals. Repeated descriptions of these components may be omitted.

First Embodiment

FIG. 1 is a perspective view showing a state in which a sound generating device according to a first embodiment is worn in an auricle.

As shown in FIG. 1, a sound generating device 10 according to the first embodiment is worn in an auricle 1 of a person. The sound generating device 10 includes a sound tube 20 and a sound generator 30. Meanwhile, in each drawing, reference numeral 2 denotes a tragus, reference numeral 3 denotes an antitragus, reference numeral 4 denotes an intertragic notch, reference numeral 5 denotes a cavum concha, reference numeral 6 denotes an external auditory foramen, and reference numeral 7 denotes an ear lobe.

The sound tube 20 is held between the tragus 2 and the antitragus 3 of the auricle 1. The sound tube 20 is formed of a material having flexibility. As the material for forming the sound tube 20, for example, silicone rubber can be used. The sound tube 20 is formed in a cylindrical shape. For example, the length of the sound tube 20 is larger than the outer diameter thereof. However, a ratio of the length of the sound tube 20 to the outer diameter is not particularly limited. Meanwhile, the length of the sound tube 20 refers to a dimension of the sound tube 20 in the direction of the center axis line of the sound tube 20. For example, the outer diameter of the sound tube 20 may be larger than a minimum dimension of an interval between the tragus 2 and the antitragus 3. The sound tube 20 includes an opening 23 at a first end 21. In this embodiment, the opening 23 is formed over the entire portion of the first end 21 of the sound tube 20. A second end 22 of the sound tube 20 is closed.

The sound generator 30 generates sound on the basis of a signal received from outside. For example, the sound generator 30 is a speaker including a vibrating plate. The sound generator 30 is disposed inside the sound tube 20. The sound generator 30 is disposed closer to the second end 22 than the first end 21 inside the sound tube 20. In this embodiment, the sound generator 30 is fixed to the bottom wall of the second end 22 of the sound tube 20. The sound generator 30 is disposed so as to radiate sound toward the opening 23. For example, in a case where the sound generator 30 is a speaker including a vibrating plate, the sound generator is disposed with the vibrating plate facing the first end 21. Although not shown in the drawing, the sound generator 30 includes a reception portion that receives a signal transmitted from an external apparatus, a signal amplification portion that amplifies the signal received by the reception portion, and the like.

The sound generating device 10 is worn in the auricle 1 using only a force acting on a portion in contact with any one of the tragus 2, the antitragus 3, the intertragic notch 4, and the cavum concha 5 in the auricle 1. In this embodiment, the sound generating device 10 is worn in the auricle 1 using a frictional force generated by the sound tube 20 coming into pressure-contact with the auricle 1. The sound tube 20 may come into pressure-contact with, for example, the tragus 2 and the antitragus 3. The outer peripheral surface of the sound tube 20 comes into contact with the intertragic notch 4. The sound generating device 10 is worn in the auricle 1 in a state in which the sound tube 20 does not block the external auditory foramen 6 and the opening 23 faces the external auditory foramen 6. The entirety of at least the sound tube 20 in the sound generating device 10 is disposed at the front of the auricle 1.

Here, characteristics of sound radiated by the sound generating device 10 will be described.

Figure 2:
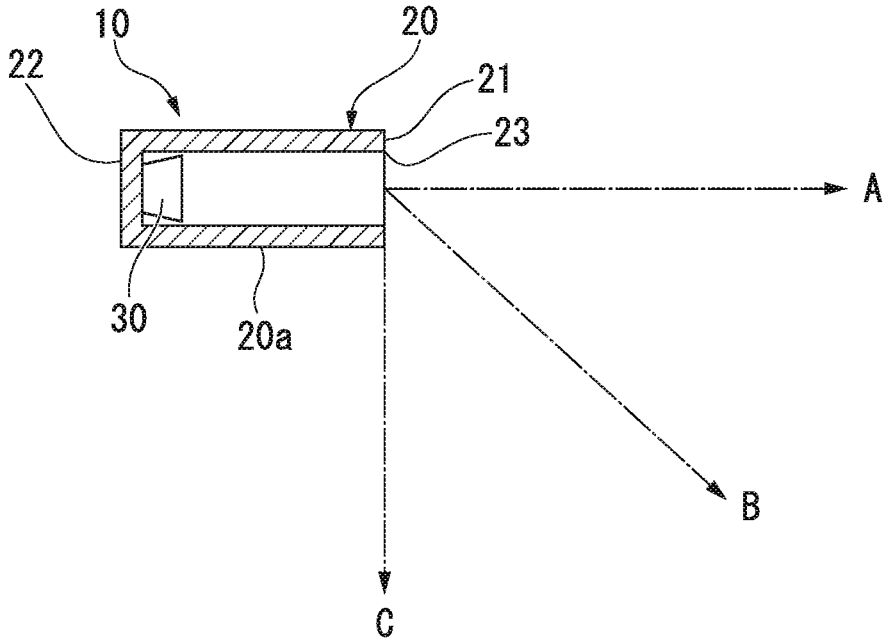
FIG. 2 is a diagram showing experimental conditions in an example.
Figure 3:
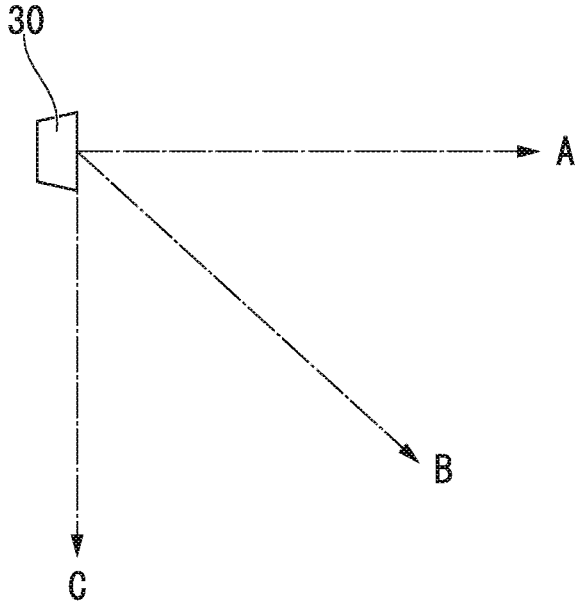
FIG. 3 is a diagram showing experimental conditions in a comparative example.

FIG. 2 is a diagram showing experimental conditions in an example. FIG. 3 is a diagram showing experimental conditions in a comparative example. Meanwhile, a configuration of the example is the sound generating device 10 according to this embodiment in which the length of the sound tube 20 is 20 mm and the inner diameter of the sound tube 20 is 10 mm. In addition, a configuration of the comparative example is solely the above-described sound generator 30. An axis A shown in FIGS. 2 and 3 is an axis extending in the normal direction of the vibrating plate of the sound generator 30 from a sound source. An axis B shown in FIGS. 2 and 3 is an axis extending from the sound source to be inclined at 45 degrees with respect to the axis A. An axis C shown in FIGS. 2 and 3 is an axis extending from the sound source to be orthogonal to the axis A.

First, the attenuation of radiated sound will be described.

Figure 4:
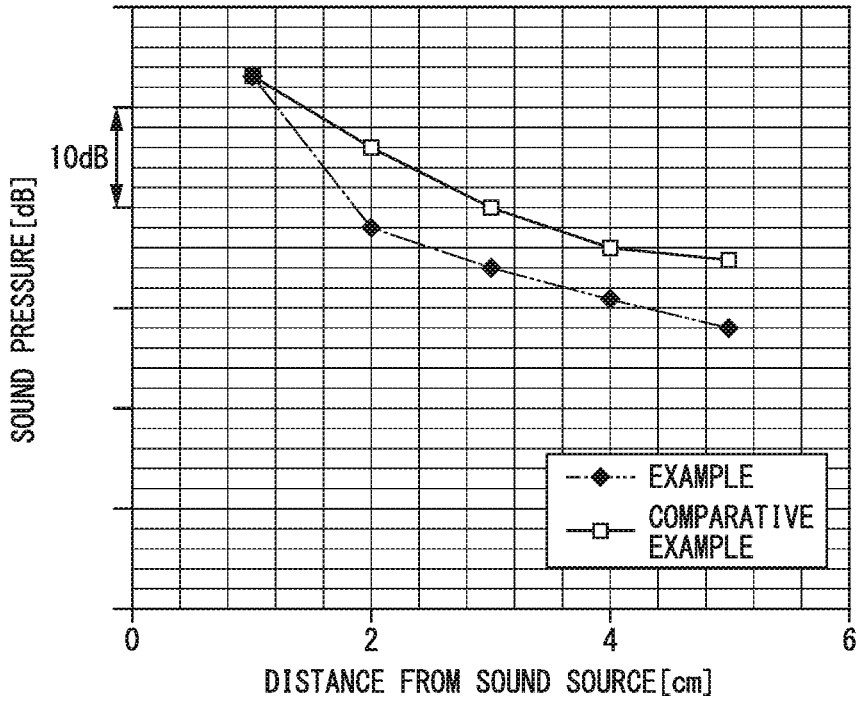
FIG. 4 is a graph showing a relationship between a sound pressure and a distance from a sound source in each of the example and the comparative example.
Figure 5:
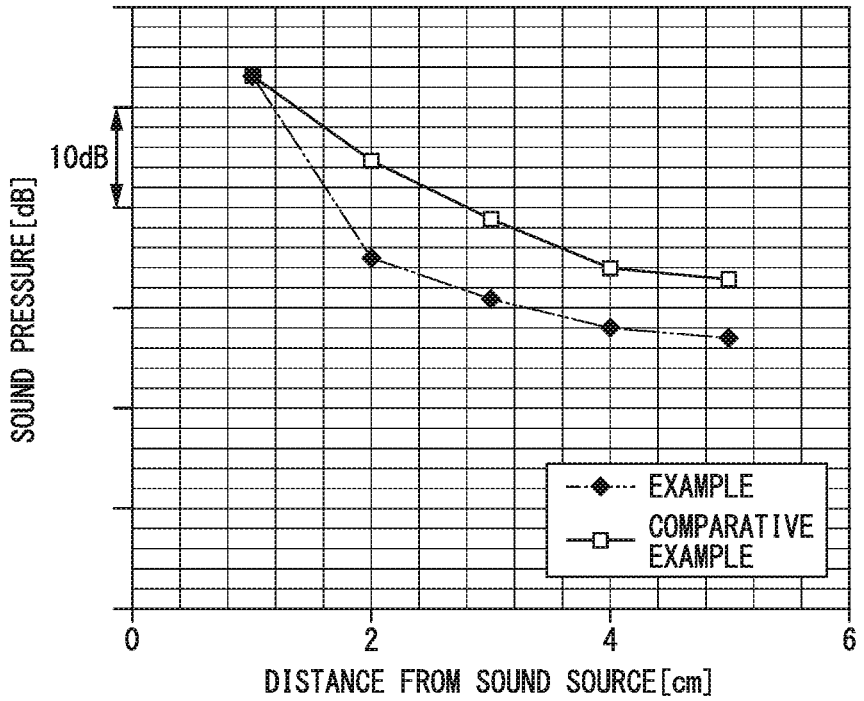
FIG. 5 is a graph showing a relationship between a sound pressure and a distance from a sound source in each of the example and the comparative example.
Figure 6:
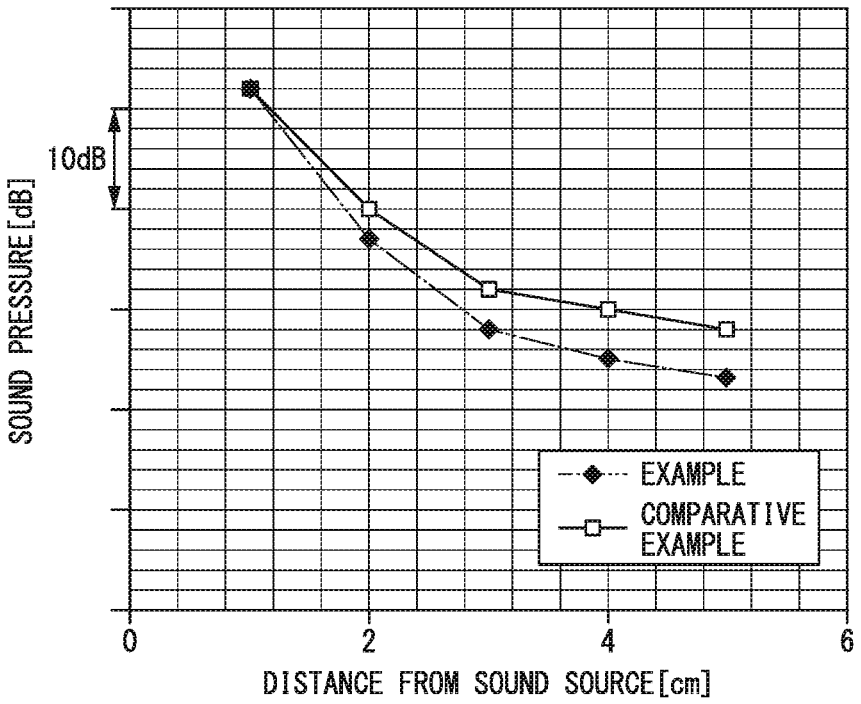
FIG. 6 is a graph showing a relationship between a sound pressure and a distance from a sound source in each of the example and the comparative example.

FIGS. 4 to 6 are graphs showing a relationship between a sound pressure and a distance from the sound source in each of the example and the comparative example. In FIGS. 4 to 6, the horizontal axis represents a distance from the sound source, and the vertical axis represents a sound pressure. Meanwhile, the distance from the sound source in the example has the opening 23 of the sound tube 20 as a starting point. FIG. 4 shows measurement results on the axis A shown in FIGS. 2 and 3. FIG. 5 shows measurement results on the axis B shown in FIGS. 2 and 3. FIG. 6 shows measurement results on the axis C shown in FIGS. 2 and 3.

As shown in FIG. 4, in both the example and the comparative example, the sound pressure attenuates with increasing distance from the sound source. Further, the sound pressure attenuates more greatly with increasing distance from the sound source in the example than in the comparative example. The same is true of results shown in FIGS. 5 and 6. According to the above results, it is possible to suppress sound leakage to the surroundings while suppressing a decrease in the sound pressure in the vicinity of the opening 23 of the sound tube 20 by disposing the sound generator 30 inside the sound tube 20. That is, it is possible to achieve both suppression of decrease in a sound pressure of sound heard by the device-wearing person and suppression of sound leakage to the surroundings.

Next, frequency characteristics of radiated sound will be described.

Figure 7:
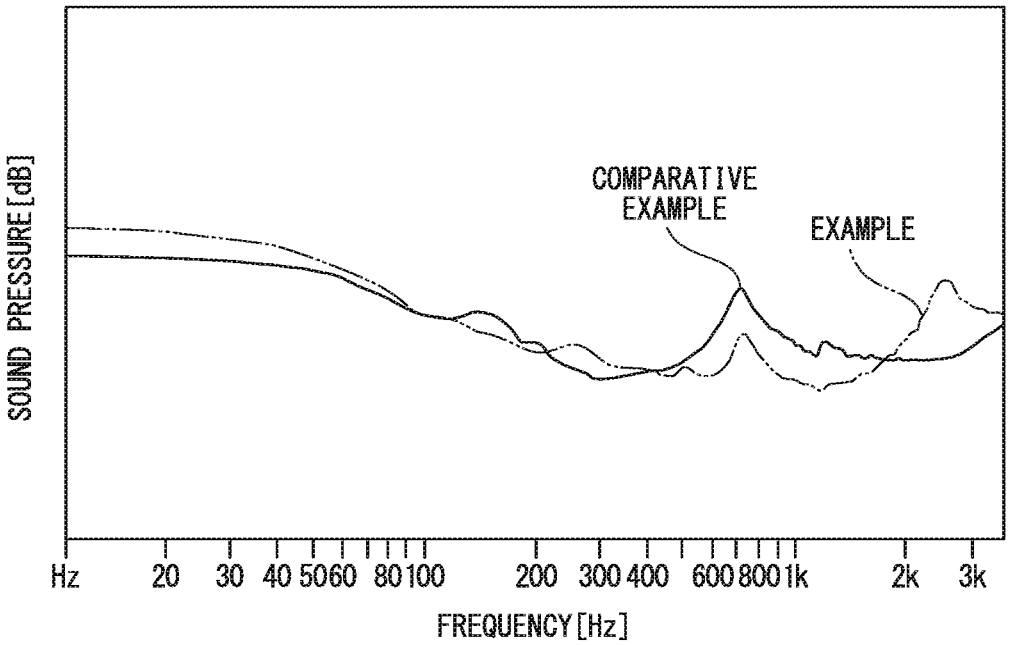
FIG. 7 is a graph showing frequency characteristics of a radiated sound in each of the example and the comparative example.

FIG. 7 is a graph showing frequency characteristics of radiated sound in each of the example and the comparative example. In FIG. 7, the horizontal axis represents a frequency, and the vertical axis represents a sound pressure. Meanwhile, in FIG. 7, the purpose of using the sound generating device 10 is to reproduce a voice instruction, and thus 3.5 kHz covering a voice band (340 Hz to 3.4 kHz) is set to be an upper limit frequency.

As shown in FIG. 7, in the comparative example, a sound pressure of approximately 800 Hz is dominant. On the other hand, in the example, a sound pressure of approximately 800 Hz becomes lower than in the comparative example due to actions of propagation and opening radiation characteristics of the sound tube 20, and a sound pressure of approximately 2500 Hz is dominant. However, the purpose of using the sound generating device 10 is not audio reproduction as described above, and thus a person wearing the sound generating device 10 does not feel a sense of incongruity. Sound having a short wavelength of approximately 2500 Hz is also easily absorbed and reflected, and thus hardly any thereof propagates to the surroundings. Further, sound radiated from the sound tube is more likely to be attenuated than in a case where there is no tube path, in correlation with properties of radiation propagation of a sound tube to be described below.

The above-described experiment results are examples, but change in frequency is not easily influenced by the length of the tube path of the sound tube in a plane wave propagation band, and thus there is an effect in spite of the tube path being short. Regarding an upper limit frequency f of the plane wave propagation band, a relation of f=sound speed×1.2/(2×bore) is established. In the above-described example, the upper limit frequency f is set to 20.4 kHz, which leads to a plane wave propagation band. Accordingly, sound radiated from the sound tube having such a size as to be held between the tragus 2 and the antitragus 3 approximates to the radiation of a point sound source at the outlet thereof. As a result, point sound source attenuation characteristics are exhibited outside the sound tube. That is, a sound pressure attenuates in inverse proportion to a distance. Therefore, sound is transmitted to the inlet of the external auditory canal (external auditory foramen) which is located several centimeters ahead, but is attenuated in the surrounding space, and thus it is possible to sense reproduction only near the ear.

According to the above-described configuration, the sound generator 30 is disposed inside the sound tube 20 which is held between the tragus 2 and the antitragus 3, and thus it is possible to suppress sound leakage to the surroundings without lowering a sound pressure of sound heard by the device-wearing person. Furthermore, since the sound tube 20 is held between the tragus 2 and the antitragus 3, the external auditory foramen 6 of the device-wearing person is not blocked by the sound generating device 10, and thus it is possible to allow the device-wearing person to hear surrounding sounds. Therefore, it is also possible to hear surrounding sounds while suppressing sound leakage to the surroundings.

In addition, since the sound tube 20 is held between the tragus 2 and the antitragus 3, it is possible to use the sound generating device 10 even while wearing glasses.

In addition, since the entirety of the sound tube 20 is disposed at the front of the auricle 1, the sound generating device 10 is miniaturized as compared to a configuration in which the sound tube extends from the front of the auricle 1 across the rear thereof. Therefore, it is possible to improve an appearance during wearing of the sound generating device 10, as compared to a configuration in which the sound tube extends from the front of the auricle 1 across the rear thereof.

In addition, the sound tube 20 has flexibility. For this reason, the sound tube 20 is elastically deformed to follow the shape of the auricle 1. Accordingly, the sound tube 20 can be engaged with the auricle 1. In addition, it is possible to reliably bring the sound tube 20 into pressure-contact with the auricle 1 using a restoring force generated when the elastically deformed sound tube 20 is elastically restored. Thus, it is possible to prevent the sound generating device 10 from falling off the auricle 1.

Further, since the sound tube 20 has flexibility, it is possible to impart a soft feeling to the device-wearing person. Accordingly, it is possible to provide the sound generating device 10 with which the device-wearing person does not easily feel fatigued even when the device-wearing person wears the sound generating device for a long time.

In addition, the sound tube 20 includes the opening 23 at the first end 21. For this reason, the sound tube 20 is held between the tragus 2 and the antitragus 3 such that the opening 23 faces the external auditory foramen 6, and thus it is possible to efficiently perform air propagation of sound radiated through the opening 23 to the eardrum through the external auditory foramen 6. Therefore, it is possible to allow the device-wearing person to easily hear sound generated by the sound generating device 10.

Meanwhile, in this embodiment, the opening 23 is formed at the first end 21 of the sound tube 20, but an opening may be formed at both the first end 21 and the second end 22. However, in this case, it is desirable that the opening formed at the second end 22 be blocked by the sound generator 30. Thereby, it is possible to efficiently radiate sound from the opening formed at the first end 21.

Figure 8:
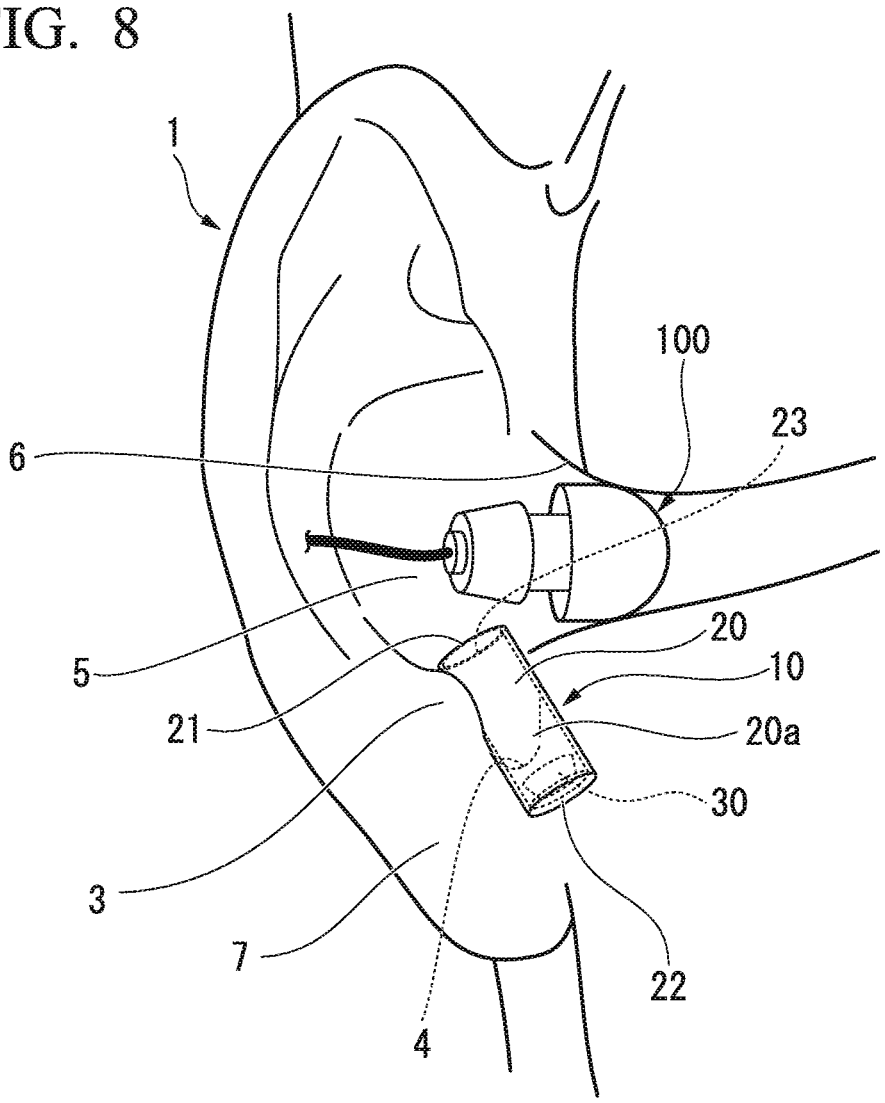
FIG. 8 is a diagram showing an example of a method of using the sound generating device according to the first embodiment.

In addition, the sound tube 20 vibrates by receiving sound generated by the sound generator 30, and may perform solid propagation of vibration to the eardrum through at least one of the tragus 2, the antitragus 3, the intertragic notch 4, and the cavum concha 5. According to this configuration, it is possible to suppress sound leakage as compared to a case where air propagation of sound is performed. In addition, since solid propagation of the sound through the auricle 1 is performed, it is also possible to use the sound generating device together with an earphone 100 of the related art which blocks the external auditory foramen 6, as shown in FIG. 8. That is, the device-wearing person can hear the sound which is propagated from the sound generating device 10 by solid propagation, while hearing sound reproduced by the earphone 100. Therefore, it is possible to make the device-wearing person hear two different types of sound.

In this embodiment, the sound tube 20 is formed of a material having flexibility, but is not limited thereto. The sound tube 20 may be formed of a hard material. As the hard material for forming the sound tube 20, for example, vinyl chloride can be used. According to this configuration, the sound tube 20 itself easily vibrates as compared to a case where the sound tube 20 has flexibility, and thus it is possible to efficiently perform solid propagation of sound to the eardrum through the auricle 1. Further, it is possible to generate vibratory radiated sound in a lower band than in a case where the sound tube 20 has flexibility.

In this embodiment, the outer peripheral surface of the sound tube 20 is in contact with the intertragic notch 4, but the entirety of the sound tube 20 may be fitted between the tragus 2 and the antitragus 3.

Next, a modification example of the first embodiment will be described with reference to FIG. 9. Meanwhile, the configuration other than the configuration to be described below is the same as that in the first embodiment.

Figure 9:
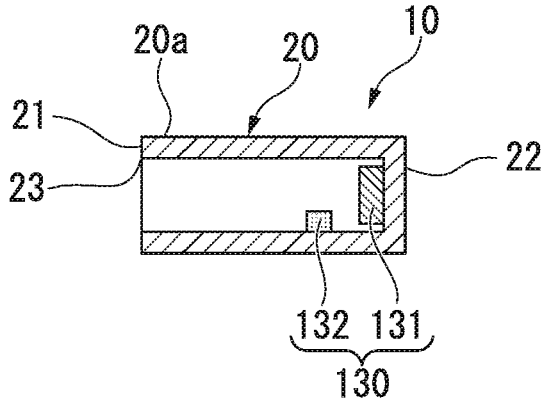
FIG. 9 is a perspective view showing a sound generating device according to a modification example of the first embodiment.

FIG. 9 is a perspective view showing a sound generating device according to the modification example of the first embodiment.

As shown in FIG. 9, in the modification example, a sound generator 130 is a member including a magnetic field generator 131 that generates a magnetic field based on a received signal, and a vibrator 132 that vibrates in accordance with changes in the magnetic field. Although not shown in the drawing, the magnetic field generator 131 includes the above-described reception portion, signal amplification portion, and the like, similar to the sound generator 30 described above. The vibrator 132 is fixed to, for example, the inner peripheral surface of the sound tube 20. Meanwhile, the vibrator 132 may be embedded into the sound tube 20.

According to this modification example, the sound generator 130 vibrates the vibrator 132 on the basis of a received signal, and thus can generate sound, similar to a speaker including a vibrating plate. In addition, since the sound tube 20 can be vibrated by the vibrator 132, it is possible to perform solid propagation of sound to the eardrum through the auricle 1.

Second Embodiment

Next, a second embodiment will be described with reference to FIG. 10. The second embodiment is different from the first embodiment in that expandable portions 140 are provided.

Figure 10:
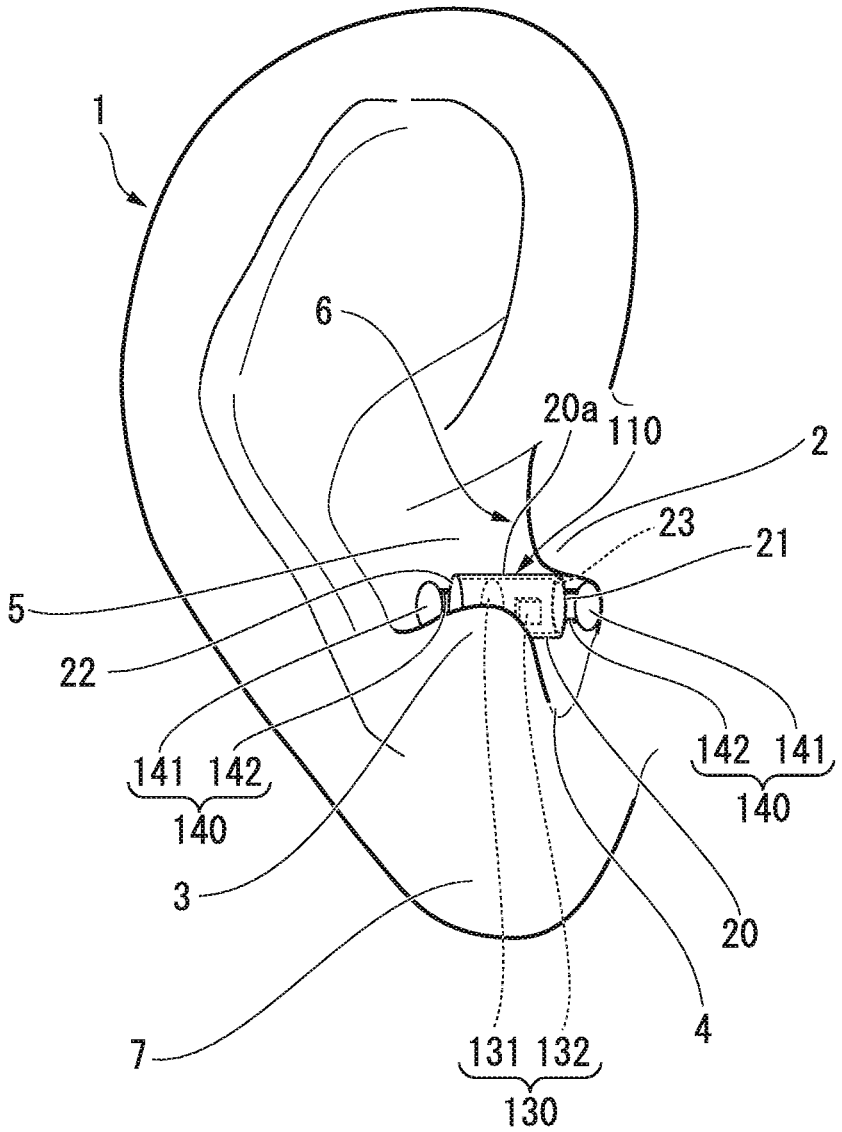
FIG. 10 is a perspective view showing a state in which a sound generating device according to a second embodiment is worn in an auricle.

FIG. 10 is a perspective view showing a state in which a sound generating device according to the second embodiment is worn in an auricle.

As shown in FIG. 10, a sound generating device 110 according to the second embodiment includes a sound tube 20, a sound generator 130, and the pair of expandable portions 140. Meanwhile, the sound generating device 110 may include the sound generator 30 mentioned above, instead of the sound generator 130.

The pair of expandable portions 140 respectively protrude from a first end 21 and a second end 22 of the sound tube 20. The expandable portion 140 includes a contact portion 141 provided at the tip thereof, and a connection portion 142 connecting the sound tube 20 and the contact portion 141 to each other. The contact portion 141 has a smooth surface. The contact portion 141 is formed, for example, in an ellipsoid shape. For example, the connection portion 142 is formed integrally with the contact portion 141. The connection portion 142 is formed to be elastically expandable. Thereby, the entirety of the expandable portion 140 elastically expands and contracts. For example, the connection portion 142 may be elastically expandable due to being formed integrally with the sound tube 20 having flexibility.

The sound generating device 110 is worn in an auricle 1 using only a force acting on a portion in contact with any one of a tragus 2, an antitragus 3, an intertragic notch 4, and a cavum concha 5 in the auricle 1. In this embodiment, the sound generating device 110 is worn in the auricle 1 in a state in which the pair of expandable portions 140 is contracted. The sound generating device 110 is worn in the auricle 1 using a restoring force generated when the expandable portions 140 are contracted. A first expandable portion 140 brings the contact portion 141 into contact with at least one of the tragus 2, the antitragus 3, the intertragic notch 4, and the cavum concha 5. A second expandable portion 140 brings the contact portion 141 into contact with a portion opposite to a portion coming into contact with the contact portion 141 of the first expandable portion 140, among the tragus 2, the antitragus 3, the intertragic notch 4, and the cavum concha 5. Thereby, the sound tube 20 is held between the tragus 2 and the antitragus 3. In the example shown in the drawing, the contact portions 141 of the pair of expandable portions 140 are in contact with the tragus 2 and the antitragus 3.

According to the above-described configuration, it is possible to bring the sound generating device 110 into pressure-contact with the auricle 1 using a restoring force generated when the expandable portions 140 are contracted. Thereby, it is possible to reliably hold the sound tube 20 between the tragus 2 and the antitragus 3.

Meanwhile, only one expandable portion 140 may be provided. Even with such a configuration, it is possible to bring the sound generating device into pressure-contact with the auricle 1 using a restoring force generated when the expandable portion 140 are contracted.

Third Embodiment

Next, a third embodiment will be described with reference to FIG. 11. The third embodiment is different from the first embodiment in that elastic portions 240 are provided.

Figure 11:
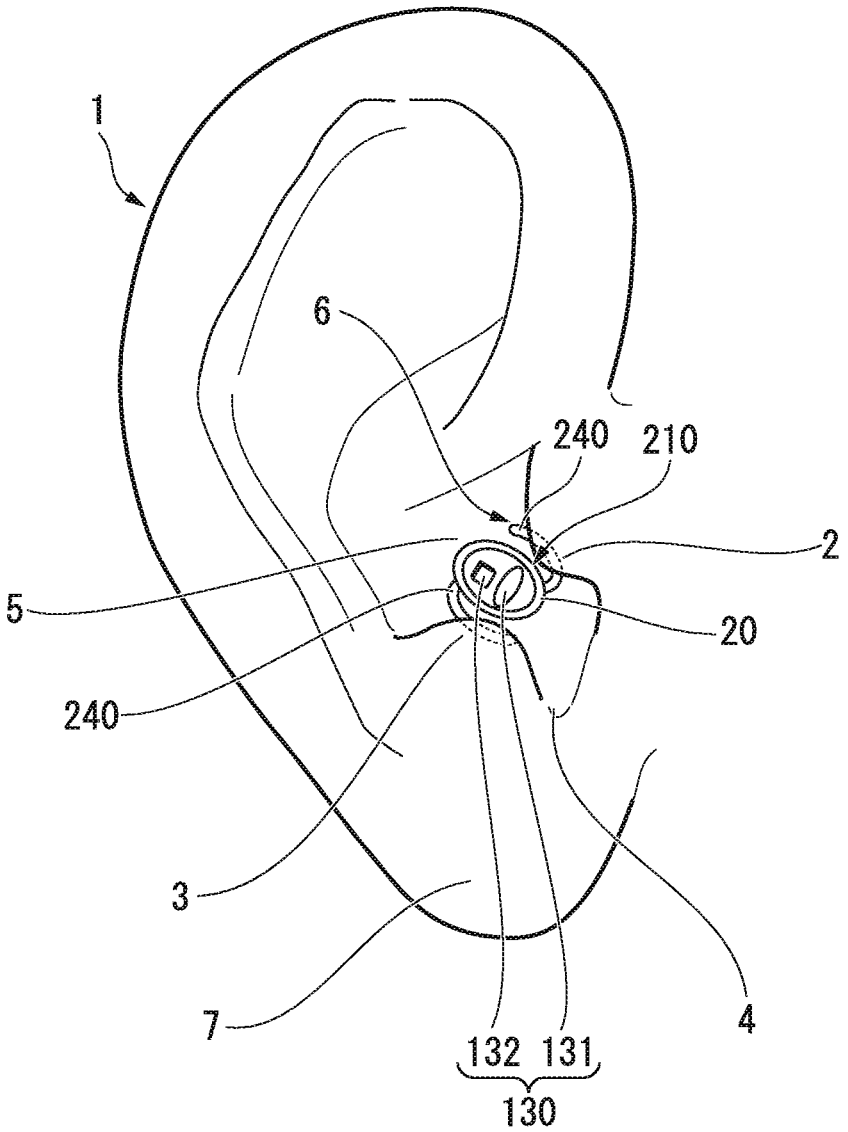
FIG. 11 is a perspective view showing a state in which a sound generating device according to a third embodiment is worn in an auricle.

FIG. 11 is a perspective view showing a state in which a sound generating device according to the third embodiment is worn in an auricle.

As shown in FIG. 11, a sound generating device 210 according to the third embodiment includes a sound tube 20, a sound generator 130, and the pair of elastic portions 240. Meanwhile, the sound generating device 210 may include the sound generator 30 mentioned above, instead of the sound generator 130.

Each of the pair of elastic portions 240 extends from the outer peripheral surface of the sound tube 20. For example, the pair of elastic portions 240 are provided to be line-symmetrical with the center axis line of the sound tube 20. The elastic portion 240 is elastically bent and deformed. For example, the elastic portion 240 is curved as a whole. The elastic portion 240 is curved with the smallest curvature at the intermediate portion thereof. The elastic portion 240 extends in substantially parallel with the outer peripheral surface of the sound tube 20 from the intermediate portion to the tip portion thereof. For example, the elastic portion 240 is elastically bendable and deformable by being formed integrally with the sound tube 20 having flexibility.

The sound generating device 210 is worn in the auricle 1 by only a force acting on a contact portion with any one of a tragus 2, an antitragus 3, an intertragic notch 4, and a cavum concha 5 in the auricle 1. In this embodiment, the sound generating device 210 is worn in the auricle 1 in a state in which the pair of elastic portions 240 are bent. The sound generating device 210 is worn in the auricle 1 using a restoring force generated when the elastic portions 240 are bent. A first elastic portion 240 comes into contact with at least one of the tragus 2, the antitragus 3, the intertragic notch 4, and the cavum concha 5. A second elastic portion 240 comes into contact with a portion opposite to a portion coming into contact with the first elastic portion 240, among the tragus 2, the antitragus 3, the intertragic notch 4, and the cavum concha 5. Thereby, the sound tube 20 is held between the tragus 2 and the antitragus 3. In the example shown in the drawing, the pair of elastic portions 240 are in contact with the tragus 2 and the antitragus 3.

According to the above-described configuration, it is possible to bring the sound generating device 210 into pressure-contact with the auricle 1 by a restoring force generated when the elastic portions 240 are bent. Thereby, it is possible to reliably hold the sound tube 20 between the tragus 2 and the antitragus 3.

Meanwhile, only one elastic portion 240 may be provided. Even with such a configuration, it is possible to bring the sound generating device into pressure-contact with the auricle 1 by a restoring force generated when the elastic portions 240 are bent.

Fourth Embodiment

Next, a fourth embodiment will be described with reference to FIG. 12. The fourth embodiment is different from the first embodiment in that a wearing supporting portion 340 is provided.

Figure 12:
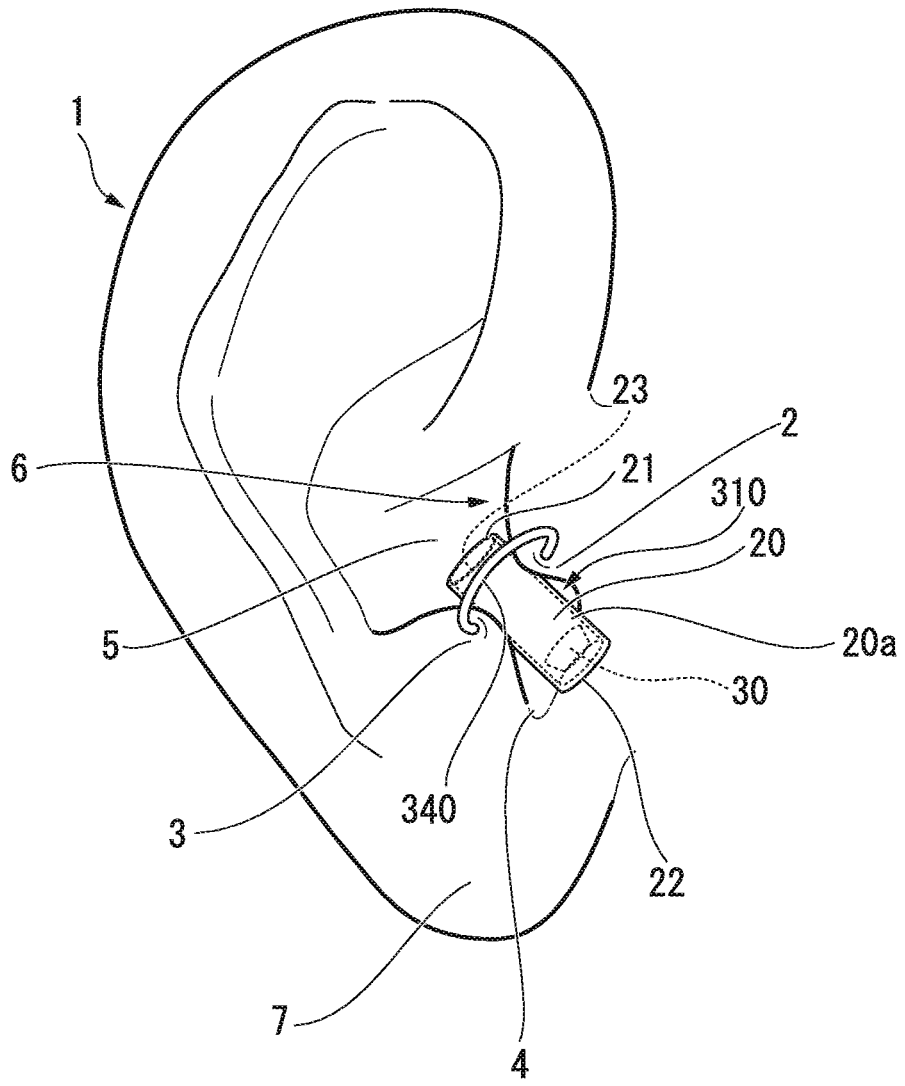
FIG. 12 is a perspective view showing a state in which a sound generating device according to a fourth embodiment is worn in an auricle.

FIG. 12 is a perspective view showing a state in which a sound generating device according to the fourth embodiment is worn in an auricle.

As shown in FIG. 12, a sound generating device 310 according to the fourth embodiment includes a sound tube 20, a sound generator 30, and the wearing supporting portion 340. Meanwhile, the sound generating device 310 may include the sound generator 130 mentioned above, instead of the sound generator 30.

For example, the wearing supporting portion 340 is a member extending in a C shape. The wearing supporting portion 340 is formed to be elastically deformable. In the wearing supporting portion 340, both ends are opened in a range where brittle fracture does not occur, and a tragus 2 and an antitragus 3 are pressed by the both ends to come close to each other. Thereby, the wearing supporting portion 340 brings the sound tube 20 into contact with the tragus 2 and the antitragus 3, and pinches the sound tube 20 between the tragus 2 and the antitragus 3. Meanwhile, the wearing supporting portion 340 may be coupled to the sound tube 20, or may be provided as a member separate from the sound tube 20.

According to the above-described configuration, it is possible to reliably hold the sound tube 20 between the tragus 2 and the antitragus 3 using the wearing supporting portion 340.

Fifth Embodiment

Next, a fifth embodiment will be described with reference to FIG. 13. The fifth embodiment is different from the first embodiment in that an extension portion 440 is provided.

Figure 13:
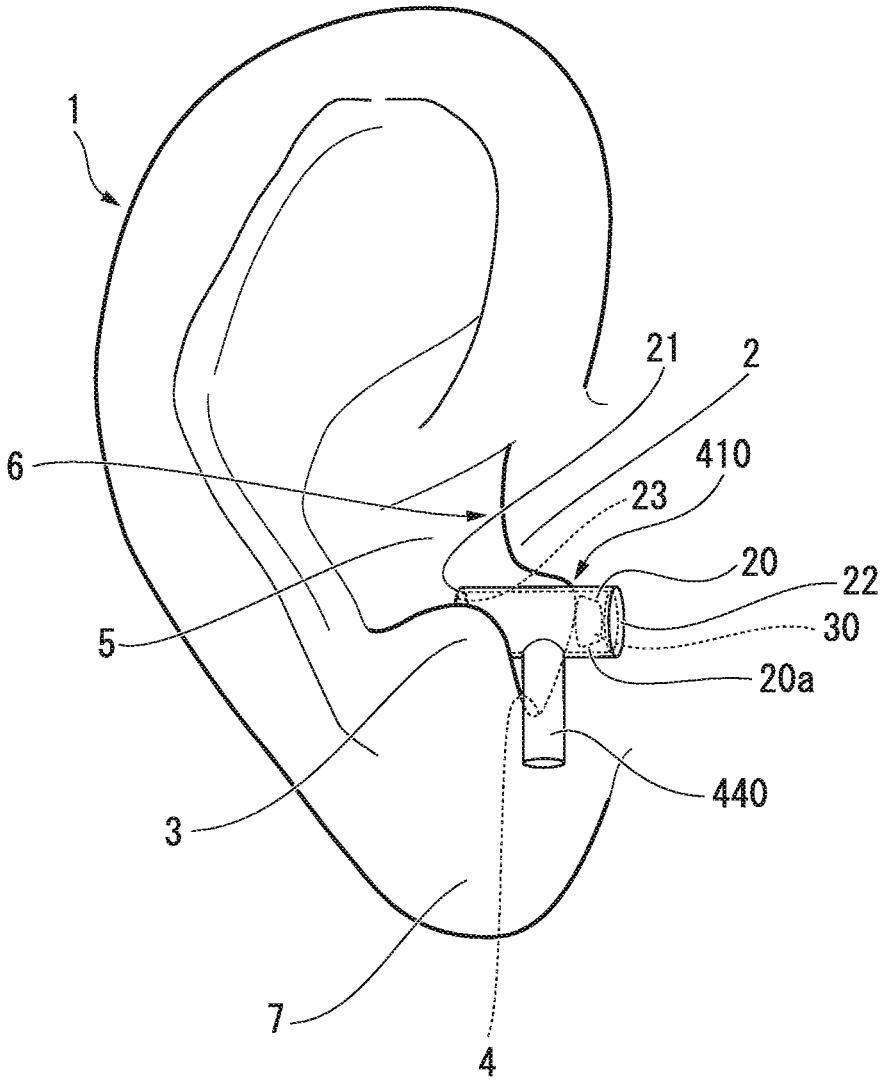
FIG. 13 is a perspective view showing a state in which a sound generating device according to a fifth embodiment is worn in an auricle.

FIG. 13 is a perspective view showing a state in which a sound generating device according to the fifth embodiment is worn in an auricle.

As shown in FIG. 13, a sound generating device 410 according to the fifth embodiment includes a sound tube 20, a sound generator 30, and the extension portion 440. Meanwhile, the sound generating device 410 may include the sound generator 130 mentioned above, instead of the sound generator 30.

The extension portion 440 extends in a direction intersecting the center axis line of the sound tube 20 from the outer peripheral surface of the sound tube 20. In this embodiment, the extension portion 440 extends from the intermediate portion on the outer peripheral surface of the sound tube 20 in the direction of the center axis line of the sound tube 20. In this embodiment, the extension portion 440 extends along a direction intersecting the center axis line of the sound tube 20. For example, the extension portion 440 is formed in a columnar shape or a cylindrical shape.

The length of the extension portion 440 is, for example, substantially the same as the length of the sound tube 20.

The sound generating device 410 is worn in an auricle 1 by only a force acting on a contact portion with any one of the tragus 2, the antitragus 3, an intertragic notch 4, and a cavum concha 5 in the auricle 1. In this embodiment, the sound generating device 410 is worn in the auricle 1 in a state in which a connection portion between the sound tube 20 and the extension portion 440 engages with the intertragic notch 4 and the extension portion 440 is in contact with an car lobe 7.

According to the above-described configuration, the sound tube 20 can be supported by the extension portion 440, and thus it is possible to suppress the displacement of the sound tube 20. Therefore, it is possible to reliably hold the sound tube 20 between the tragus 2 and the antitragus 3.

Sixth Embodiment

Next, a sixth embodiment will be described with reference to FIG. 14. The sixth embodiment is different from the first embodiment in that a protrusion portion 540 is provided.

Figure 14:
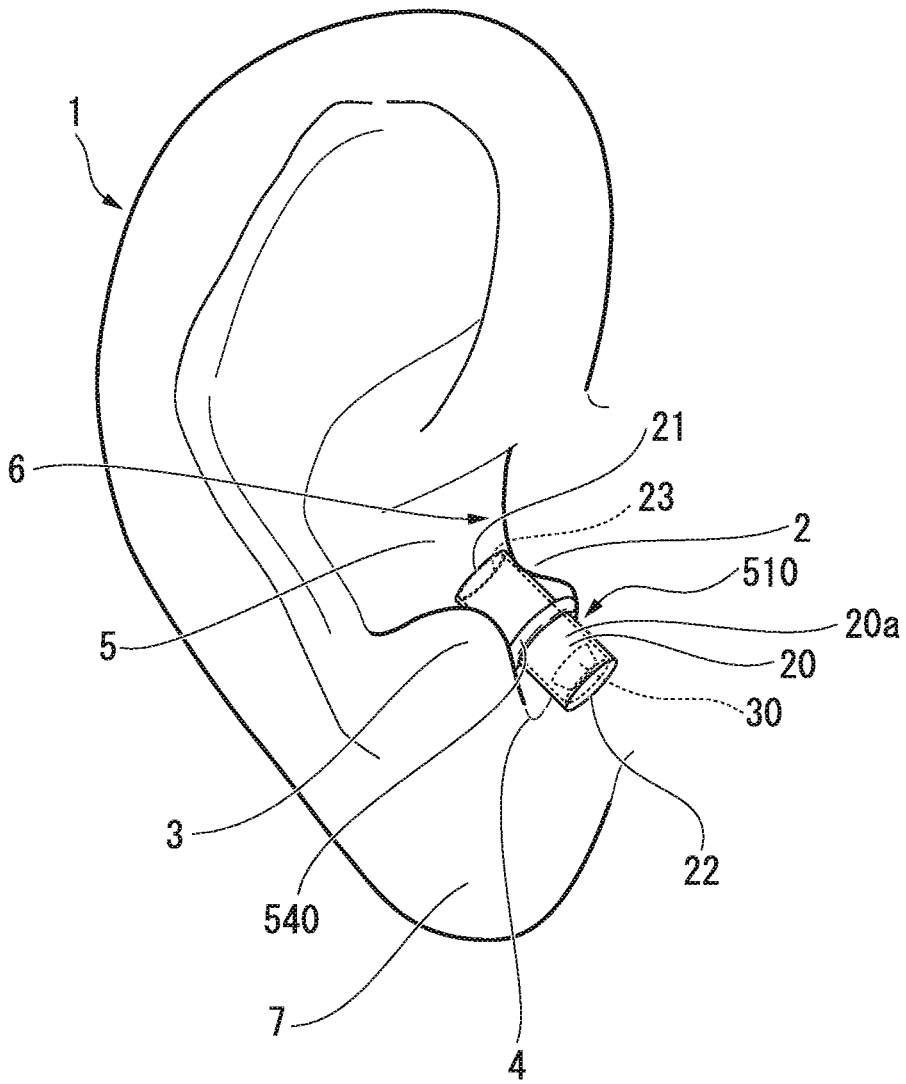
FIG. 14 is a perspective view showing a state in which a sound generating device according to a sixth embodiment is worn in an auricle.

FIG. 14 is a perspective view showing a state in which a sound generating device according to the sixth embodiment is worn in an auricle.

As shown in FIG. 14, a sound generating device 510 according to the sixth embodiment includes a sound tube 20, a sound generator 30, and the protrusion portion 540. Meanwhile, the sound generating device 510 may include the sound generator 130 mentioned above, instead of the sound generator 30.

The protrusion portion 540 protrudes from the outer peripheral surface of the sound tube 20. The protrusion portion 540 extends over the entire circumference along the circumferential direction around the center axis line of the sound tube 20. Thereby, the protrusion portion 540 has an annular shape. The height of the protrusion portion 540 is sufficiently smaller than, for example, the outer diameter of the sound tube 20. The protrusion portion 540 may be formed integrally with the sound tube 20, or may be formed separately from the sound tube 20.

The sound generating device 510 is worn in an auricle 1 by only a force acting on a contact portion with any one of a tragus 2, an antitragus 3, an intertragic notch 4, and a cavum concha 5 in the auricle 1. Any first portion in the protrusion portion 540 comes into contact with any one of the tragus 2, the antitragus 3, and the intertragic notch 4. A second portion different from the first portion in the protrusion portion 540 comes into contact with a portion opposite to a portion coming into contact with the first portion, among the tragus 2, the antitragus 3, and the intertragic notch 4. In the example shown in the drawing, the protrusion portion 540 engages with the intertragic notch 4.

According to the above-described configuration, since the protrusion portion 540 protrudes from the outer peripheral surface of the sound tube 20, the protrusion portion 540 can be engaged with any one of the tragus 2, the antitragus 3, and the intertragic notch 4. For this reason, it is possible to reliably hold the sound tube 20 between the tragus 2 and the antitragus 3, as compared to a case where the protrusion portion 540 is not provided. Furthermore, since the protrusion portion 540 extends over the entire circumference along the circumferential direction of the sound tube 20, it is possible to easily adjust the position of the sound tube 20 during the wearing of the sound generating device 510, as compared to a case where the protrusion portion extends intermittently.

Seventh Embodiment

Next, a seventh embodiment will be described with reference to FIG. 15. The seventh embodiment is different from the first embodiment in that a first end 21 of a sound tube 20 is closed and an opening 24 penetrating a peripheral wall 20*a* is provided.

Figure 15:
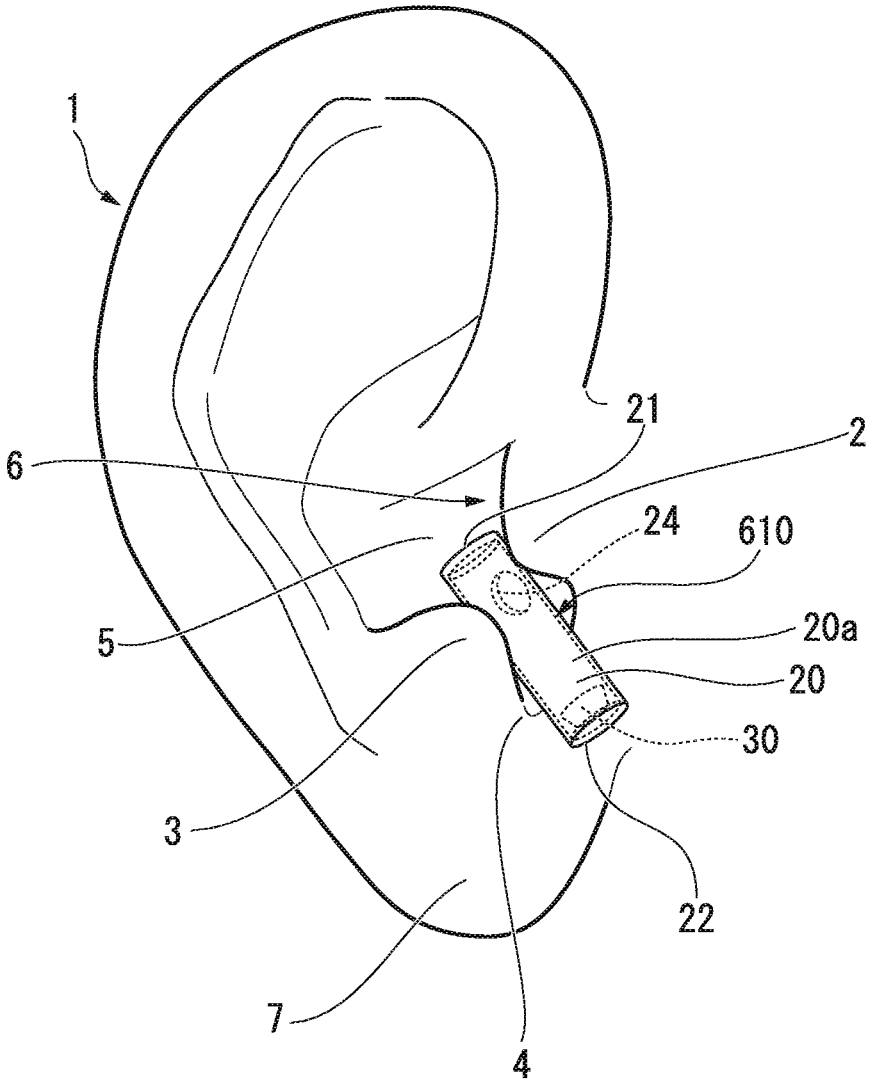
FIG. 15 is a perspective view showing a sound generating device according to a seventh embodiment.

FIG. 15 is a perspective view showing a sound generating device according to the seventh embodiment.

As shown in FIG. 15, a sound generating device 610 according to the seventh embodiment includes a sound tube 20 and a sound generator 30. Meanwhile, the sound generating device 610 may include the sound generator 130 mentioned above, instead of the sound generator 30. The first end 21 and a second end 22 of the sound tube 20 are closed. The sound tube 20 includes the opening 24 penetrating the peripheral wall 20*a*. The sound generating device 610 is worn in an auricle 1 with the opening 24 facing an external auditory foramen 6.

According to the above-described configuration, it is possible to position the opening 24 in the vicinity of the external auditory foramen 6 even when the sound tube 20 is disposed to straddle the external auditory foramen 6. Therefore, it is possible to extend an installable range of the sound generating device 610, as compared to a case where an opening is formed at the end of the sound tube.

Eighth Embodiment

Next, an eighth embodiment will be described with reference to FIG. 16. The eighth embodiment is different from the first embodiment in that a sound generator 130 is installed in an annular member 720.

Figure 16:
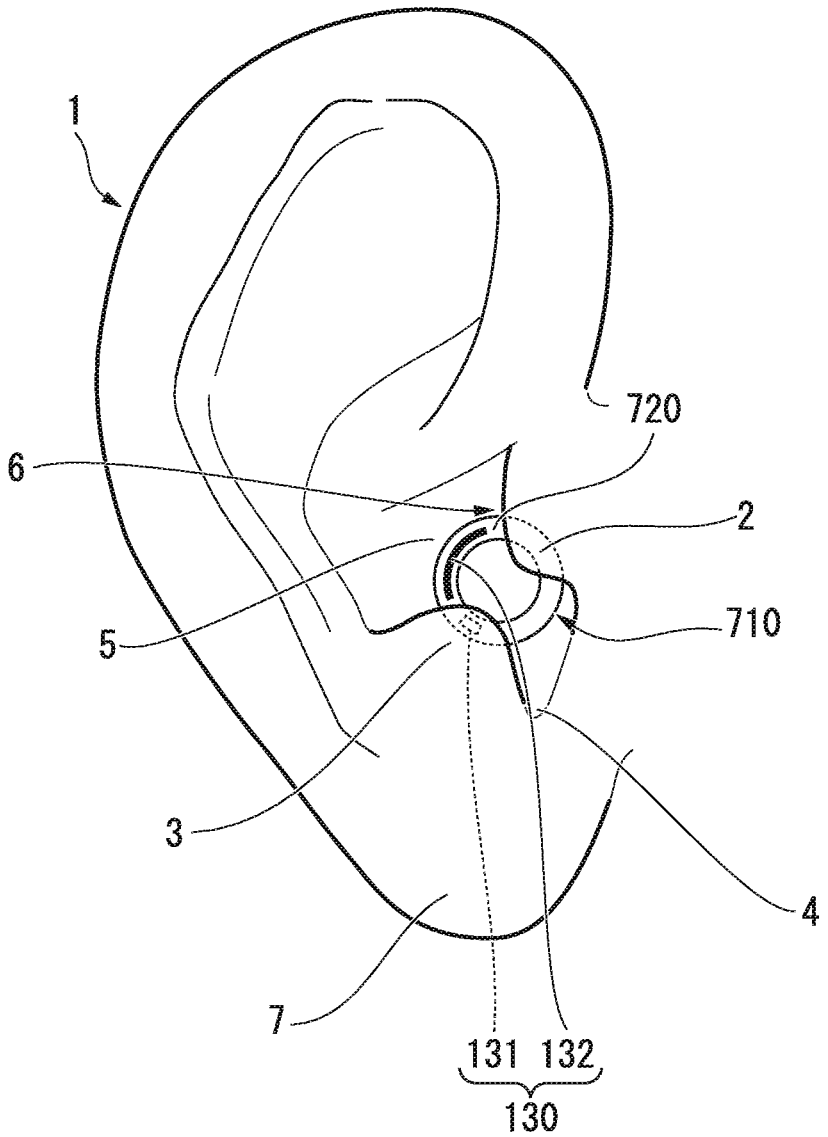
FIG. 16 is a perspective view showing a state in which a sound generating device according to an eighth embodiment is worn in an auricle.

FIG. 16 is a perspective view showing a state in which a sound generating device according to the eighth embodiment is worn in an auricle.

As shown in FIG. 16, a sound generating device 710 according to the eighth embodiment includes the annular member 720 and the sound generator 130. The annular member 720 is formed in an annular shape. That is, the annular member 720 is formed in a cylindrical shape in which a dimension in the direction of the center axis line thereof is sufficiently smaller than the outer diameter thereof. The annular member 720 is held by a cavum concha 5. The annular member 720 opens an external auditory foramen 6 to the outside through a penetration portion formed in the center of the annular member. A magnetic field generator 131 and a vibrator 132 of the sound generator 130 are fixed to the annular member 720. The vibrator 132 may be embedded into the annular member 720. The sound generating device 710 is worn in an auricle 1 using only a force acting on a contact portion between the annular member 720 and the cavum concha 5. In this embodiment, the sound generating device 710 is worn in the auricle 1 due to a frictional force generated by the annular member 720 coming into pressure-contact with the cavum concha 5.

According to the above-described configuration, it is possible to wear the sound generating device 710 in the vicinity of the external auditory foramen 6 without blocking the external auditory foramen 6 of the device-wearing person. Accordingly, it is possible to make the device-wearing person hear surrounding sounds. Therefore, it is also possible to hear surrounding sounds while suppressing sound leakage to the surroundings.

In each of the above-described embodiments, the sound generating device is singly worn in the auricle 1, but the wearing of the sound generating device in the auricle 1 may be supported by pressing the sound tube 20 against the auricle 1, for example, by means of a member holding the device-wearing person's head.

According to at least one of the above-described embodiments, the sound tube held between the tragus and the antitragus and the sound generator disposed inside the sound tube are provided, and thus it is also possible to hear surrounding sounds while suppressing sound leakage to the surroundings.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sound generating device comprising:

a sound tube to be held between a tragus and an antitragus so as not to block an external auditory foramen;

a sound generator disposed inside the sound tube; and a protrusion portion protruding from an outer peripheral surface of the sound tube and extending over an entire circumference along a circumferential direction around a center axis line of the sound tube.

2. A sound generating device comprising:

a sound tube to be held between a tragus and an antitragus so as not to block an external auditory foramen; and a sound generator disposed inside the sound tube, wherein the sound tube includes an opening penetrating a peripheral wall.

3. A sound generating device comprising:

an annular member formed in an annular shape, to be held by a cavum concha, and opening an external auditory foramen to an outside through a penetration portion formed in the center of the annular member; and a sound generator includes a magnetic field generator generating a magnetic field based on a received signal, and a vibrator fixed to the annular member and vibrating the annular member in accordance with changes in the magnetic field generated by the magnetic field generator disposed in the annular member.

4. A sound generating device comprising:

a sound tube to be held between a tragus and an antitragus so as not to block an external auditory foramen;

a sound generator disposed inside the sound tube; and an extension portion extending in a direction intersecting the center axis line of the sound tube from the sound tube and formed so as to be in contact with an ear lobe.

* * * * *